United States Patent [19]

Cox et al.

[11] 4,060,138

[45] Nov. 29, 1977

[54] VIBRATORY TOOLS

[75] Inventors: William Edward Cox, Great Missenden; Frank James Lee, Okehampton, both of England

[73] Assignee: Post Office, London, England

[21] Appl. No.: 703,665

[30] Foreign Application Priority Data

July 11, 1975 United Kingdom .....29244

[22] Filed: July 8, 1976

[51] Int. Cl.[2] ..... H01B 17/00

[52] U.S. Cl. ..... 173/49; 173/162

[58] Field of Search ..... 173/49, 170, 162, 139; 267/137

[56] References Cited

U.S. PATENT DOCUMENTS

| | | | |
|---|---|---|---|
| 1,431,808 | 10/1922 | Jackson | 173/162 |
| 2,035,643 | 3/1936 | Douglass et al. | 173/162 |
| 2,420,793 | 5/1947 | O'Connor | 173/49 |
| 2,831,463 | 4/1958 | Ekstrom et al. | 267/137 |
| 3,275,089 | 9/1966 | Kaiser et al. | 173/162 |
| 3,583,497 | 6/1971 | Kossowski et al. | 173/49 |
| 3,824,417 | 7/1974 | Moores | 173/162 |

*Primary Examiner*—Robert A. Hafer
*Attorney, Agent, or Firm*—Hall & Houghton

[57] ABSTRACT

A vibratory tool in which, to reduce vibration of the handle, a vibration isolation mechanism is provided to connect the handle to the tool body. In the preferred embodiment, the mechanism comprises two beams associated with respective torsionally-resistant members which convert translational oscillation of the tool body into forced angular oscillation of the beams about respective induced nodal axes. The tool handle is connected to the beams at these nodal axes.

11 Claims, 4 Drawing Figures

VIBRATORY TOOLS

The present invention relates to hand-held vibratory tools and is particularly applicable to tools for boring or drilling into earth.

A problem associated with tools of this type is that the vibrations imparted to the tool head may also be imparted to the handle, making the tool difficult to use.

One known method of vibration isolation involves the use of custom-made springs to connect the system to be isolated to the vibrating body. In such an arrangement, a low stiffness of the springs is necessary to achieve good isolation. Thus, a comparatively large mass must be used to achieve a satisfactory level of isolation: the stiffness of the spring cannot be reduced significantly or a loss of "feel" in the tool results. The system can never achieve perfect isolation at any specific frequency, and the guidance necessary for conventional coil springs would impose restraints upon the free movements of the handle of a tool (that is, tilting, swivelling etc.). Moreover, the system would require lubrication and regular maintenance.

An alternative arrangement uses a spring mass tuned to the frequency of the vibrating body and attached to the body to absorb the vibration, but this arrangement also has disadvantages.

The present invention provides a vibratory tool in which the handle is connected to the body of the tool by a vibration isolation mechanism comprising at least one beam connected to the tool body, and at least one torsionally-resilient member so mounted relative to the beam as to convert translational oscillation of the tool body into forced angular oscillation of the beam about an induced nodal axis perpendicular to the beam, the handle being connected to the beam at the said nodal axis.

Preferably, the torsionally-resilient member provides the connection between the beam and the tool body.

The connection between the beam and the handle should be such as to offer no resistance to rotational movement in the said plane. The connection may, for example, include a link pivoted at one end on the beam at the said nodal axis and pivoted at the other end on the handle.

To prevent the collapse of the vibration isolation mechanism, the connection between the beam and the handle may be such as to permit only restricted translatory movement of the handle relative to the beam. To this end, the connection may include a resilient member attached to the handle and, at the said nodal axis, to the beam.

In an embodiment of the invention, the vibration isolation mechanism comprises two beams pivotally connected to the tool body and, for each beam, at least one respective torsionally-resilient member, the torsionally-resilient members being so mounted relative to the beams as to convert translational oscillation of the tool body into forced angular oscillation of each beam about a respective induced nodal axis perpendicular to the beam, the handle being connected to the beams at the said nodal axes.

By way of example, vibratory tools constructed in accordance with the invention will be described with reference to the accompanying drawings, in which.

Figure 1:
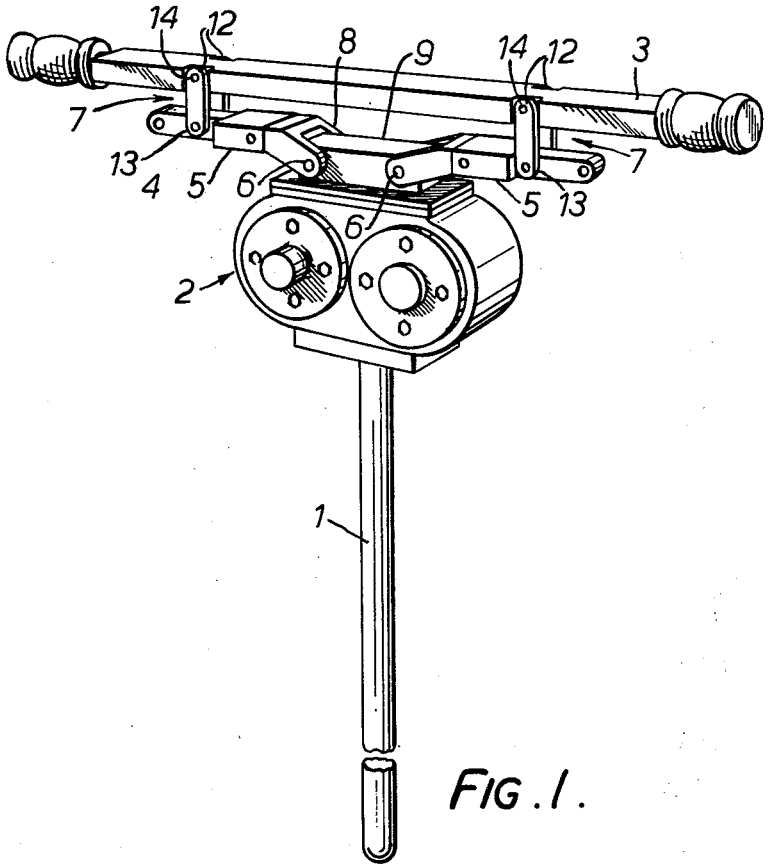
FIG. 1 is a perspective view of a tool.

The vibratory tools illustrated in the drawings are for boring small diameter holes in earth for the purpose of determining the location of cables and pipes, particularly gas supply pipes and telephone and electricity supply cables.

Referring now to FIG. 1 the tool head comprises a rod 1 extending from the tool body 2 which houses a vibrator for producing axial harmonic vibrations in the rod. The tool is manipulated by a handle 3 mounted on the body 2 and, in use, the vibrations set up in the rod 1 enable the rod to be driven into the ground, producing a small diameter bore into which, if required, a suitable detector can be inserted to indicate the location of any service pipes and cables in the vicinity. The use of a vibratory borer for this purpose is preferable since it is unlikely to damage a cable or pipe which it contacts. Moreover, an experienced operator is likely to be able to tell, from the feel of the borer, when an obstacle has been hit and the nature of the obstacle.

The nature of the tool head and of the vibrator housed in the body 2 form no part of the present invention and need not be described in great detail. The vibrator may be of any suitable known type: it may, for example, comprise two eccentric masses mounted symmetrically about the longitudinal axis of the rod 1 and rotatable in the same plane but in opposite directions by an appropriate drive arrangement to which reference will be made later. The eccenteric masses are coupled to the rod 1 so that, upon rotation of the masses, the required axial vibration of the rod is produced.

Figure 2:
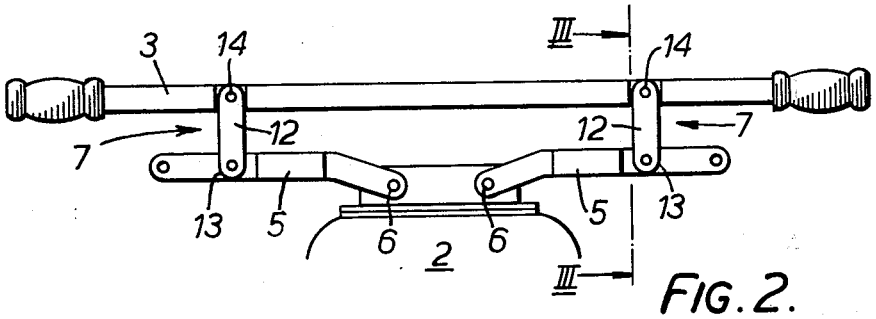
FIG. 2 shows, diagrammatically, the vibration isolation mechanism of the tool.

To prevent the vibrations set up in the rod 1 from being transmitted to the handle 3 to an undesirable extent, the handle is coupled to the body 2 by a vibration isolation mechanism indicated generally in FIG. 1 at 4 and shown diagrammatically in FIG. 2. The isolation mechanism comprises two identical beams 5 disposed symmetrically about the centre line of the tool and extending outwardly from the body 2 in a direction generally parallel to the handle 3. At its inner end, each beam is pivotally coupled at 6 to the tool body 2 and, towards its outer end, is coupled at 7 to the handle 3. The nature and location of these connections 6, 7 will be described below.

Figure 4:
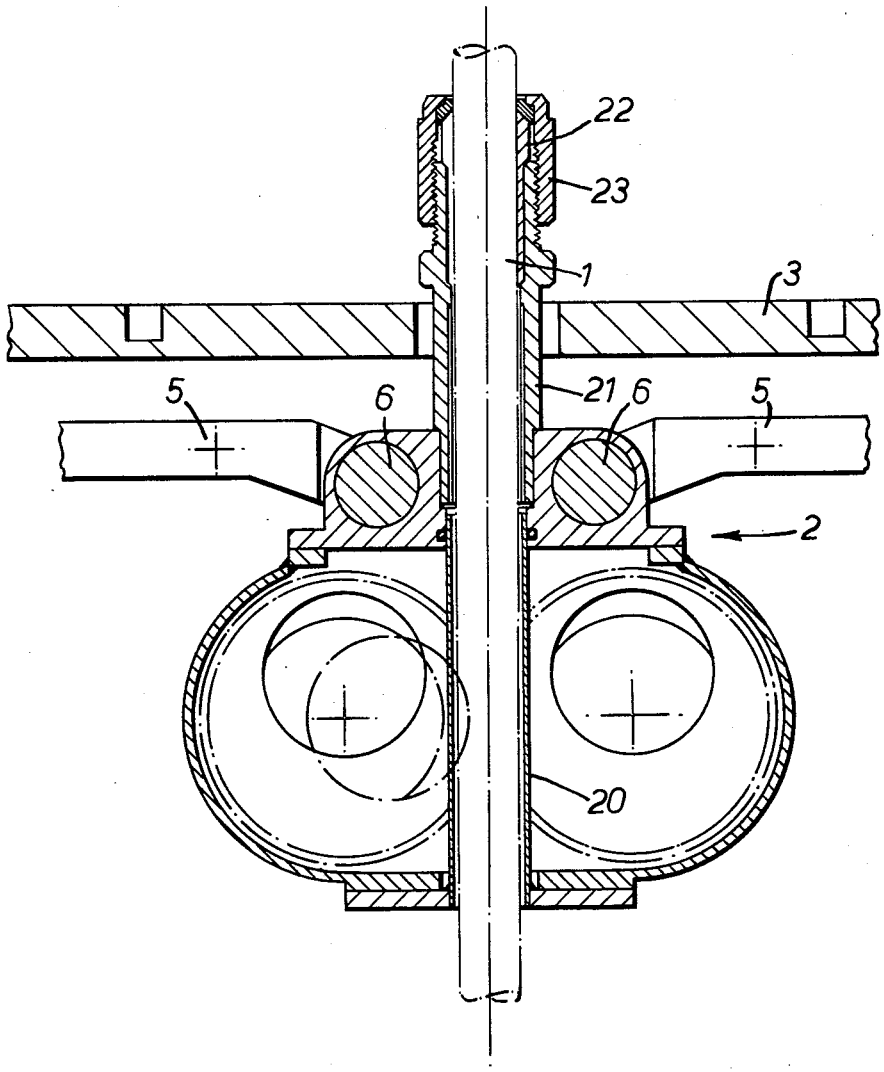
FIG. 4 is a scrap longitudinal cross section of another tool.

As shown in FIG. 1, the inner ends 8 of the beams are forked to embrace an upstanding portion 9 of the tool body, the pivotal connection 6 between each beam 5 and the tool body 2 being provided by a torsionally-resilient member in the form of a resilient bush (which is not shown in FIG. 1 but which does appear in FIG. 4, described below). The function and characteristics of these bushes will be described in greater detail below: for the present it is sufficient to state that "Metalastik" ultra duty rubber bushes have been found to be suitable.

The connection 7 between each beam 5 and the handle 3 comprises a pair of links 12 (one on each side of the beam) each link being pivoted at one end 13 to the beam and at the other end 14 to the handle 3. Each pivot 13, 14 gives complete freedom of rotation about an axis parallel to those of the bushes at the connections 6, but only limited rotation about other axes.

Figure 3:
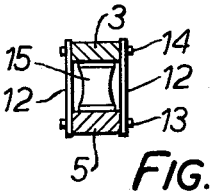
FIG. 3 is a view on the line III—III of FIG. 2.

Located between each pair of links 12, but not forming an effective part of the isolation mechanism, is a resilient bush 15 (FIG. 3) secured to one end to the handle 3 and at the other end to the beam 5. The purpose of the bushes 15 will be described below.

When the borer is in use, a forced harmonic vibration is applied from the tool body 2 to the forked ends 8 of the beams 5, or, more particularly, the translational oscillation of the body is coverted by the bushes at the connections 6 into forced angular oscillation of the beams. The theory of the movement of a beam under these conditions is well known and shows that the beam will oscillate about an induced nodal axis perpendicular to the length of the beam. The position of the nodal axis varies during movement of the beam but, provided certain operating conditions are fulfilled, it can be regarded as fixed: in the vibration isolation mechanism 4, it is at this notional fixed nodal axis of each beam 5 that the pivotal connections to the links 12 are made. Movement of the beam at its induced nodal axis is purely rotational and, since the connections between the beams 5 and the handle 3 offer no resistance to such movement, the latter is effectively isolated from the vibrating body 2. Moreover, the oscillatory movement of each beam at its induced nodal axis is independent of any external vertical forces applied to the beam at this point.

The position of the nodal axes, in practice, is dependent on the frequency of the applied harmonic vibration and the movement of this position is time dependent. It can be shown, however, that the frequency-dependence of the nodal psotions decreases as the frequency increases and that the time dependence decreases as the damping in the system decreases, each nodal axis tending towards a fixed position determined by the moment of inertia of the beam about its centre of gravity the mass of the beam and the position at which the vibratory motion is applied. Accordingly, the borer is arranged to operate at a comparatively high frequency and the damping introduced by the bushes at the connections 6 is kept to a minimum. It is impossible to eliminate the damping completely and the associated movement of the nodal axes of the beams 5 is translated to the handle as small vertical movements, but it has been found that the vibration isolation facility is not appreciably affected.

Turning again to FIG. 3, the bushes 15 located between the links 12 do not, as already mentioned, form an effective part of the vibration isolation mechanism 4, and are provided solely to resist movement of the handle 3 relative to the tool in a direction parallel to the length of the handle and thereby prevent the collapse of the isolation mechanism 4.

In the design of a specific vibration isolation mechanism, practical considerations will determined characteristics such as the torsional stiffness of the bushes at the connections 6; the point of connection of a beam 5 to the tool body 2 and the acceptable size of any vertical movements of the handle 3 during operation of the tool. The first two characteristics will be determined by the level of the force likely to be applied to the tool to push it into and pull it out of the ground, while the maximum value of the last-mentioned characteristic is determined by the comfort of the operator. The positions of the pivots 13 can then be tailored to requirements by a careful choice of the mass of the beams, the torsional stiffness of the bushes and the moment of inertia of each about its centre of gravity.

For example, a tool has been developed (incorporating a vibration isolation mechanism as described above) which falls within the guidelines of a draft British Standard on human exposure to hand-arm system vibration. This draft Standard covers use of a vibratory tool by an operator for intervals of 150 minutes and 400 minutes in any 8 hour period, and gives maximum permissible displacements of the tool handle at various frequencies in each case, the permissible displacements for the 400 minute interval being, as would be expected, substantially smaller than those for the 150 minutes interval. The tool was developed with a view to satisfying (and did indeed satisfy) the requirements of the 400 minute interval since the larger displacements permitted for the 150 minute interval were found to be subjectively uncomfortable even though medically approved. The vibration isolation mechanism incorporated in the tool had the following characteristics:

| | | |
|---|---|---|
| mass of each beam 5 | = | 2.59 lbm |
| moment of inertia of each beam 5 about its centre of gravity | = | 7.36 lbm in$^2$ |
| torsional stiffness of the bush at each connection 6 | = | 325 lbf in/rad |
| the ratio of the damping coefficient c to the critical damping coefficient $C_c$ that is $\frac{c}{C_c}$ | = | 0.048 |
| the peak vertical displacement applied to the beam 5 | = | 0.062 in |

The optimum operating frequency of the tool was 450 rad/sec.

Various modifications are possible in the vibration isolation mechanism 4. For example, although each of the pivotal connections 13 must be located at a nodal axis of vibration for the associated beam 5, the connections 6 between the tool body 2 and the beam can be located at any point along the length of the latter (other than at the nodal axis) with a consequent alteration in the position of the nodal axis. Moreover, the resilient bushes described above as forming part of the connections 6 need not be located at these connections although, for practical purposes the connections 6 provide one of the preferred locations: an alternative practical location for these bushes is at the nodal axes (pivotal connections 13), and bushes could even be located at both the connections 6 and the nodal axes. Finally, although the connections 6 between the beams 5 and the tool body 2 have been described as including torsionally-resilient bushes, a similar effect could be achieved by replacing these bushes by torsion springs.

A further modification of the tool described above is illustrated in FIG. 4 in which corresponding components carry the same reference numerals as in FIG. 1. This modification facilitates the boring of a very deep hole and involves the provision of a passage 20 through the tool body 2 with an extension 21 which extends from the tool body and projects through a hole in the handle 3 without touching the latter. The rod 1 is located in the passage 20 and extension 21 and is secured by a three-part collet 22 which is clamped to the rod by a locking sleeve 23 screwed down on to the extension. The rod 1 is provided with several extension pieces and, when a longer rod is required, an extension piece is coupled to the upper end of the rod. The sleeve 23 is then undone, allowing the lengthened rod to be slid through and is then retightened before the tool is used.

Turning now to the vibrator housed in the body 2 it was mentioned above that this may comprise a contra-rotating weights system. One possible drive arrangement for the weights includes a flexible twist drive member having one end fitted into an axial Keyway in a drive shaft of a motor and its other end fitted into a Keyway along the rotational axis of one of the weights.

In this arrangement, a gear system in the tool head provides a corresponding drive to the other weight.

An alternative drive arrangement for the contra-rotating weights utilizes a pneumatic drive and enables the gear system to be omitted, thus producing a lighter and more reliable structure. In this arrangement, the weights are mounted on (or are integral with) respective vanes or rotors which are rotable in cylindrical chambers and which, in operation, enable the contra-rotating weights to synchronize quickly and automatically with each other. With this alternative drive arrangement it is preferred that the handle 3 of the tool extend parallel to the rotational axes of the weights, rather than perpendicular to them as shown in the Figures. This disposition of the handle 3 reduces the possibility of distortion of the tool due to the application of unequal pressures at the two ends of the handle, which in turn can cause the contra-rotating weights to go out of synchronization. The self-synchronization may also be achieved using closely-matched vibrators driven by other power sources.

We claim:

1. A vibratory tool having a handle, a body and a vibration isolation mechanism connecting the handle to the body, the vibration isolation mechanism comprising two beams pivotally connected to the tool body and, for each beam, at least one respective torsionally-resilient member, the torsionally-resilient members being so mounted relative to the beams as to convert translational oscillation of the tool body into forced angular oscillation of each beam about a respective induced nodal axis located perpendicular to the beam and at a position along the length thereof, and means pivotally connecting the handle to each beam at the said nodal axis, which means offers substantially no resistance to rotational movement of the beam in a plane to which the nodal axis is perpendicular.

2. A tool as claimed in claim 1, in which each pivotal connection between the handle and a beam includes a link pivoted at one end to the beam and at the other end to the handle.

3. A tool as claimed in claim 1, which a torsionally-resilient member provides the connection between each beam and the tool body.

4. A tool as claimed in claim 1, in which each torsionally-resilient member is a resilient bush.

5. A tool as claimed in claim 1, in which each pivotal connection between the handle and the beams permits only restricted translatory movement of the handle relative to the beams, thereby to prevent collapse of the vibration isolation mechanism.

6. A tool as claimed in claim 5, in which each connection includes a resilient member connected between the handle and the beam.

7. A tool as claimed in claim 1, for boring or drilling into earth and in which the tool head comprises a bore rod extending from the tool body and coupled to the vibratory mechanism of the tool.

8. A tool as claimed in claim 7, in which the bore rod is releasably secured in the tool, whereby the operative length of the rod is adjustable.

9. A tool as claimed in claim 1, in which the vibratory mechanism of the tool comprises a contra-rotating weights system.

10. A tool as claimed in claim 9, including a pneumatic drive for the contra-rotating weights.

11. A vibratory tool having a handle, a body and a vibration isolation mechanism connecting the handle to the body, the vibration isolation mechanism comprising at least one beam connected to the tool body, and at least one torsionally-resilient member so mounted relative to the beam as to convert translational oscillation of the tool body into forced angular oscillation of the beam about an induced nodal axis located perpendicular to the beam and at a position along the length thereof, and means pivotally connecting the handle to the beam at the said nodal axis, which means offers substantially no resistance to rotational movement of the beam in a plane to which the nodal axis is perpendicular.

* * * * *